US006705335B2

(12) United States Patent
You

(10) Patent No.: US 6,705,335 B2
(45) Date of Patent: Mar. 16, 2004

(54) COLLAPSIBLE FRAME STRUCTURE FOR SELF-OPENING UMBRELLA

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 10/109,710

(22) Filed: Apr. 1, 2002

(65) Prior Publication Data

US 2002/0189655 A1 Dec. 19, 2002

(30) Foreign Application Priority Data

Jun. 14, 2001 (TW) ..... 87206352A02 U

(51) Int. Cl.[7] ..... A45B 25/16

(52) U.S. Cl. ..... 135/22; 135/28; 135/29

(58) Field of Search ..... 135/25.1, 25.3, 135/25.31, 29, 30, 31, 32, 22

(56) References Cited

U.S. PATENT DOCUMENTS

| | | | | | |
|---|---|---|---|---|---|
| 6,076,540 | A | * | 6/2000 | You | 135/22 |
| 6,158,452 | A | * | 12/2000 | You | 135/26 |
| 6,314,976 | B1 | * | 11/2001 | Clarke | 135/28 |
| 6,345,637 | B1 | * | 2/2002 | Ko | 135/22 |
| 6,397,866 | B1 | * | 6/2002 | You | 135/23 |

* cited by examiner

*Primary Examiner*—Janet M. Wilkens
(74) *Attorney, Agent, or Firm*—Dennison, Schultz, Dougherty & MacDonald

(57) ABSTRACT

A collapsible frame structure is provided for umbrella with self-opening mechanism. The collapsible frame structure is more durable than the prior art by using enforced light-weighted materials such as FRP to form the umbrella frame and steel bars to form the linkage beams. Each of the second pivotal-coupling device of the supporting rib is integrally formed with each of the inner linking member of the supporting rib so as to form a compound pivotal-coupling device. Therefore, the collapsible frame structure is easy in assembly process and the yield ratio is also increased.

3 Claims, 4 Drawing Sheets

COLLAPSIBLE FRAME STRUCTURE FOR SELF-OPENING UMBRELLA

BACKGROUND OF THE INVENTION

1. Field of the Invention

This invention relates to umbrellas, and more particularly, to a collapsible frame structure for umbrella with a self-opening mechanism that allows the umbrella, after being collapsed, to be opened automatically without manual effort from the user. Furthermore, each of the second pivotal-coupling device is integrally formed with the inner linking member of the support rib. Therefore, according to the present invention, it is easy and fast in assembly process without having to set a correct position of the second pivotal-coupling device at the supporting rib.

2. Description of Related Art

A collapsible umbrella (also called a foldable umbrella) allows the user to collapse the umbrella when the umbrella is not in use for easy storage or carriage. Collapsible umbrellas are typically provided with a self-opening mechanism that allows the umbrella, after being collapsed, to be opened automatically without manual effort from the user. Conventional collapsible umbrellas, as shown in FIG. 4 is U.S. Pat. No. 6,076,540 which is assigned to the same applicant of the present invention, however, it can not be easily assembled during manufacturing due to setting position of coupling structure of supporting rib in the collapsible frame structure encountering difficulties, which will be illustratively described in the followings.

In assembly, the inner end of the main rib 15 is coupled to the upper running hub 14; the inner end of the supporting rib 17 is coupled to the intermediate running hub 13 and the outer end of the same is coupled to the middle of the main rib 15 by means of the first pivotal-coupling device 16; and the linkage beam 19 is connected to the second pivotal-coupling device 18 by hooking its upper hook and to the bottom running hub 11 by hooking its bottom hook.

The correct coupling position of the second pivotal-coupling device 18 is at the hooking position of the upper hook of the linkage beam 19. It means that the second pivotal-coupling device 18 should be installed at a correct position of the supporting rib 17 with respect to the inner linking member 173. This is because that the elasticity of the spiral spring 12 is related to the force and the speeds of opening and folding an umbrella. The faster the speed, the larger the force required to operate the umbrella. Furthermore, the force and the speeds of opening and folding an umbrella also relate to the correct position of the second pivotal-coupling device 18. Therefore, in mass production, how to fix the second pivotal-coupling device 18 to a correct position at the supporting rib 17 has become an important problem to be resolved.

In general, for increasing the yield, it is often the quality is deteriorated. Furthermore, if the assembly work is performed in night, the quality will further deteriorate.

SUMMARY OF THE INVENTION

It is therefore an objective of the present invention to provide a collapsible frame structure for self-opening umbrella, wherein the quality is improved by deleting the carelessness of the operator in assembly process.

Another object of the present invention is to provide a collapsible frame structure for self-opening umbrella, wherein the second pivotal-coupling device of the supporting rib is integrally formed with the inner linking member of the support ribs so as to form a compound pivotal-coupling device. Therefore, the invention is easy and fast in assembly process without having to set the correct position of the second pivotal-coupling device at the supporting rib. Furthermore, the yield ratio will be increased.

A further object of the present invention is to provide a collapsible frame structure for the self-opening umbrella, wherein in storing the umbrella, the linkage beam can be stored in the trench. Therefore, the volume of the frame between the intermediate running hub and the bottom running hub can be reduced. Therefore, an umbrella with two ribs can be stored in compact volume.

In accordance with the foregoing and other objectives of the present invention, an improved collapsible frame structure is provided for self-opening umbrella. The collapsible frame structure of the invention includes:

a main shaft; a bottom running hub slidably mounted on the main shaft; an intermediate running hub slidably mounted on the main shaft; an elastic member mounted on the main shaft between the bottom running hub and the intermediate running hub; an upper running hub fixedly mounted on a top of the main shaft; a plurality of main ribs, each being made from enforced FRP and having one end pivotally linked to the upper running hub; a plurality of supporting ribs having a double-bar beam portion, each being made from enforced FRP and having an outer linking member formed at one end thereof pivotally connected to the main rib, an inner linking member formed at the other end thereof pivotally linked to the intermediate running hub; a plurality of linkage beams, each being made from a steel bar formed with a bottom hook connected to the bottom running hub and an upper hook pivotally coupled to each of the supporting rib; a plurality of first pivotal-coupling devices, each coupling an outer end of each of the supporting rib to each of the main rib, each of the first pivotal-coupling devices including a tubular member to have each of the main rib to pass therethrough and at least one ear formed thereunder with a hole pivotally connected to each of the outer linking member of the supporting rib; a plurality of second pivotal-coupling devices each being made through injection molding with nylon plastics, each coupling the upper hook of each of the linkage beam to each of the supporting rib and each of the second pivotal-coupling devices including a linking member having two parallel through holes formed therein to allow the double-bar beam portion of each of the supporting rib to pass through, said linking member being formed with a plurality of pivotal shafts therebetween so as to be hooked with the upper hook of each of the linkage beams, allowing each of the linkage beam to be pivotally coupled to each of the supporting ribs; and each of the second pivotal-coupling device of the supporting rib being integral formed with each of the inner linking member of the supporting rib so as to form a compound pivotal-coupling device.

BRIEF DESCRIPTION OF DRAWINGS

The invention will be more fully understood by reading the following detailed description of the preferred embodiments, with reference made to the accompanying drawings, wherein.

DETAILED DESCRIPTION OF PREFERRED EMBODIMENTS

Figure 1:
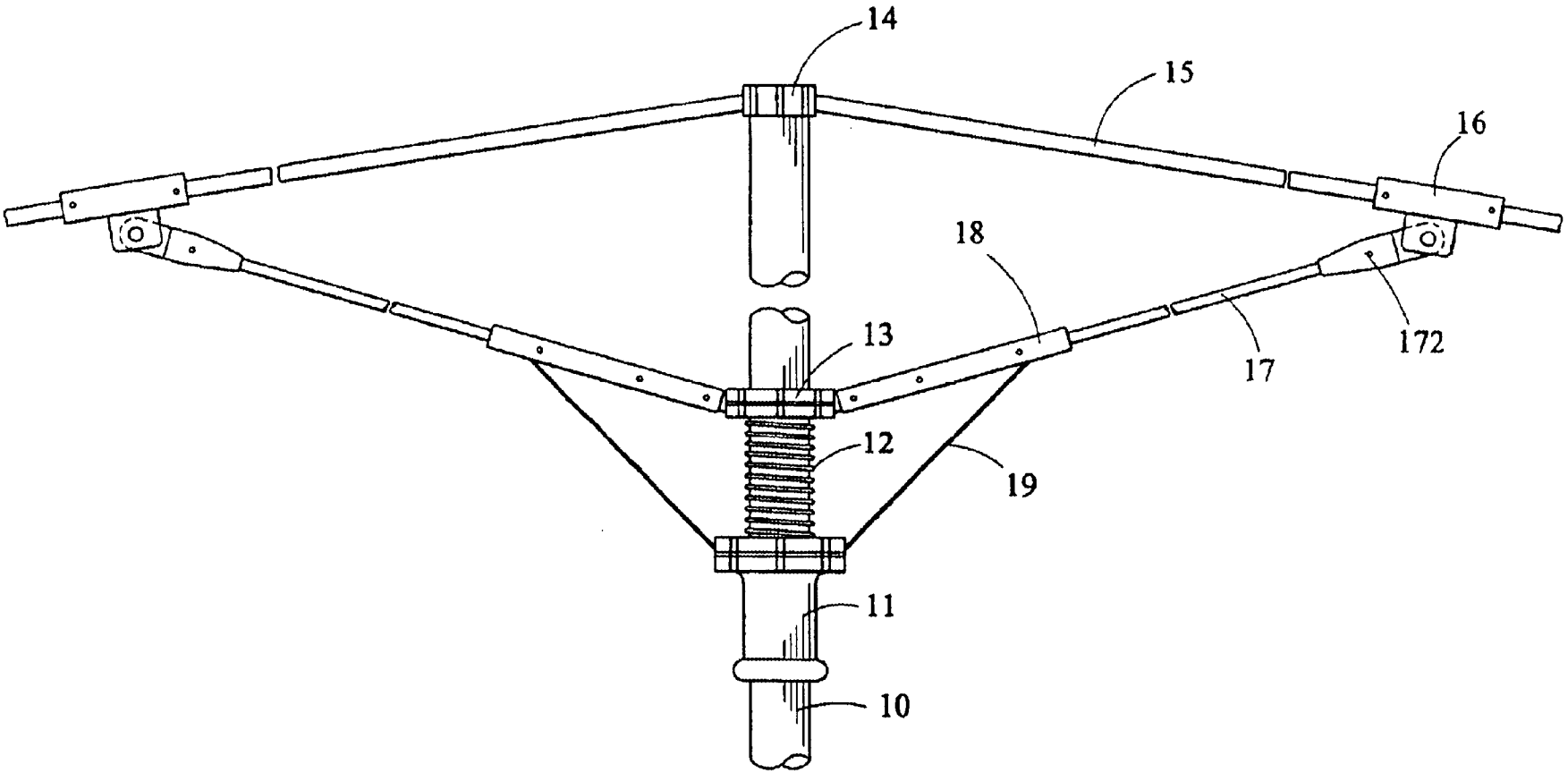
FIG. 1 is a plane schematic view of a self-opening umbrella according to the present invention.
Figure 2A:
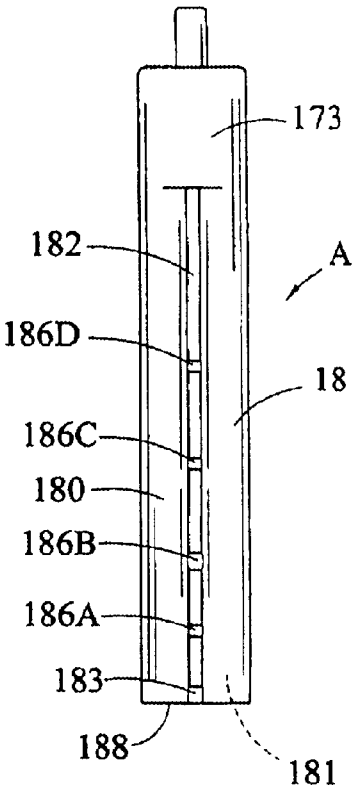
FIG. 2A is a plane view of second pivotal-coupling device of FIG. 2.
Figure 2:
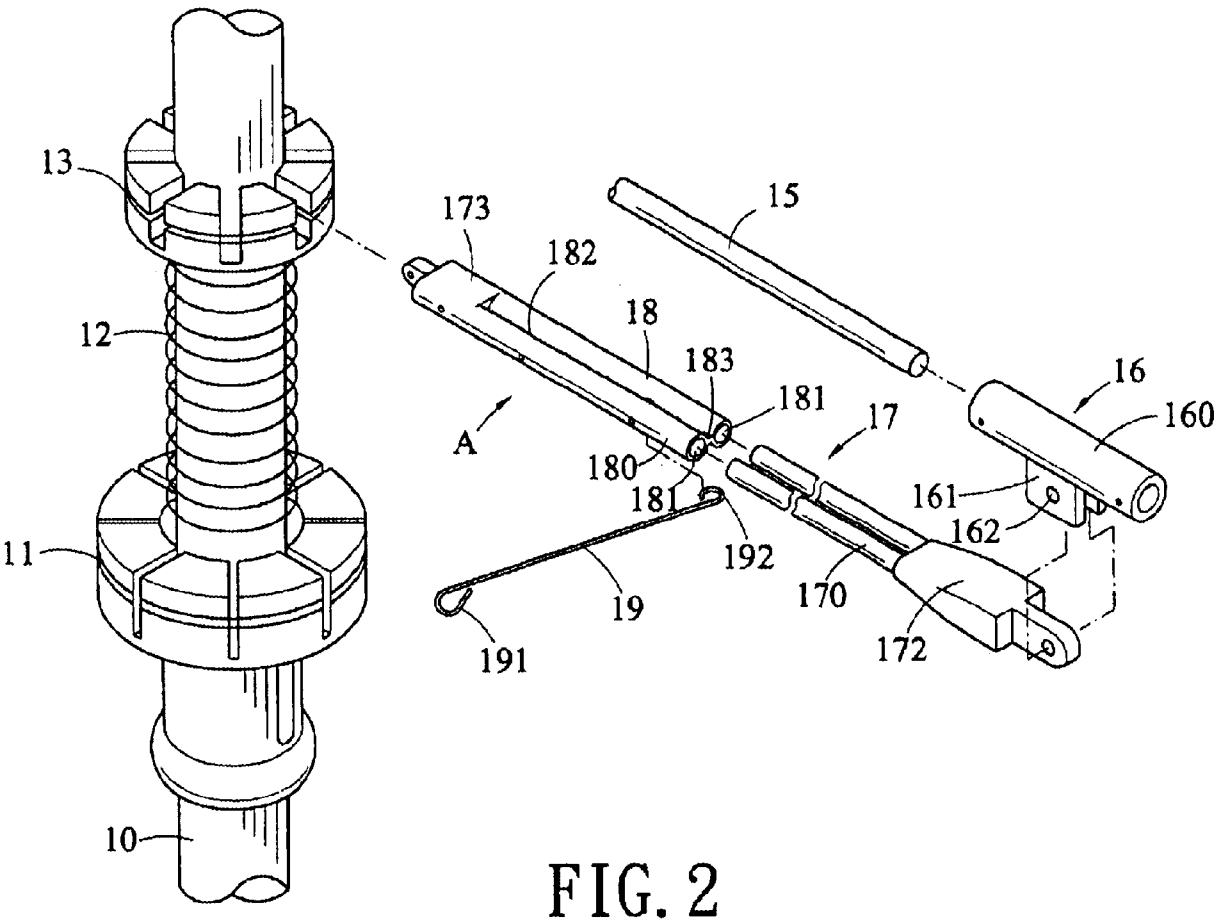
FIG. 2 is an exploded perspective view of the rib structure of the present invention for self-opening umbrella.

A preferred embodiment of the collapsible frame structure according to the invention is illustrated in FIGS. 1 and 2. As shown, the collapsible frame structure of the invention includes a main shaft 10, a bottom running hub 11, an elastic member such as a spiral spring 12, an intermediate running hub 13, an upper running hub 14, a radiating frame of main ribs 15, a first pivotal-coupling device 16, a frame of supporting ribs 17, a second pivotal-coupling device 18, and a frame of linkage beams 19 between the second pivotal-coupling device 18 and the bottom running hub 11. The present invention has a second pivotal-coupling device 18 for coupling each supporting rib 17 to the associated linkage beam 19. Moreover, for the purpose of making the umbrella more light-weighted, the main rib 15 and the supporting rib 17 are all made from a reinforced light-weighted material, such as fabric reinforced plastics (FRP), while the first pivotal-coupling device 16 on the main rib 15 and the second pivotal-coupling device 18 on the supporting rib 17 are formed by injection molding with nylon plastics.

The supporting rib 17 has a double-bar beam portion, each of one end formed with an outer linking member 172 and the other end formed with an inner linking member 173, with the outer and inner linking members 172, 173 each formed with a double-coupling hole for coupling the double-bar beam portion of the supporting rib 17 (the beam-portion of the supporting rib 17 is a double-bar beam structure 170 including two parallel bars) to the intermediate running hub 13 and the first pivotal-coupling device 16, respectively. Adhesives or ultrasonic wave welding techniques can be used to combine the main rib 15 and the supporting rib 17 with the pivotal-coupling devices. The first pivotal-coupling device 16 includes a tubular member 160 formed with a pair of ears 161. The first pivotal-coupling device 16 allows the supporting rib 17 to be pivotally coupled to the main rib 15. The supporting rib 17 and the outer and inner linking members 172, 173 are also formed through injection molding with nylon plastics. The linkage beam 19 is made of a steel bar which is bent into the shape shown in FIG. 2 with a bottom hook 191 at one end and an upper hook 192 at the other end.

Figure 3:
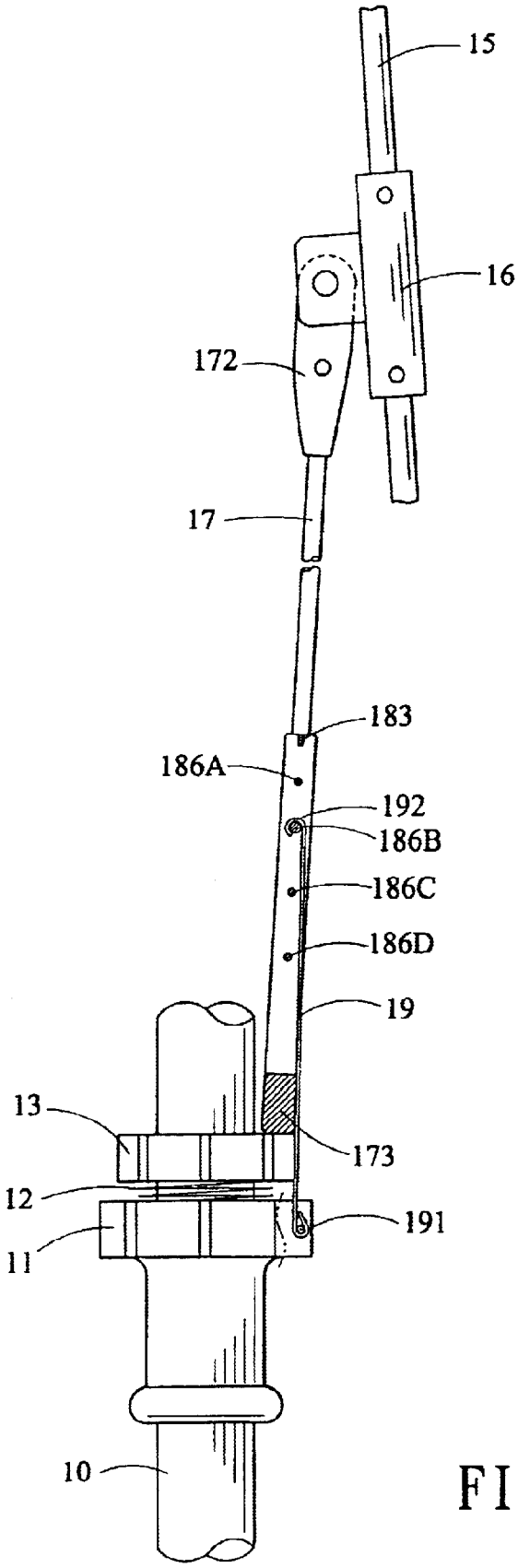
FIG. 3 is a plane schematic view of a folded umbrella, wherein a part is a cross-sectional view for showing each of the linkage beam is hidden in each of the second pivotal-coupling device of the present invention.
Figure 4:
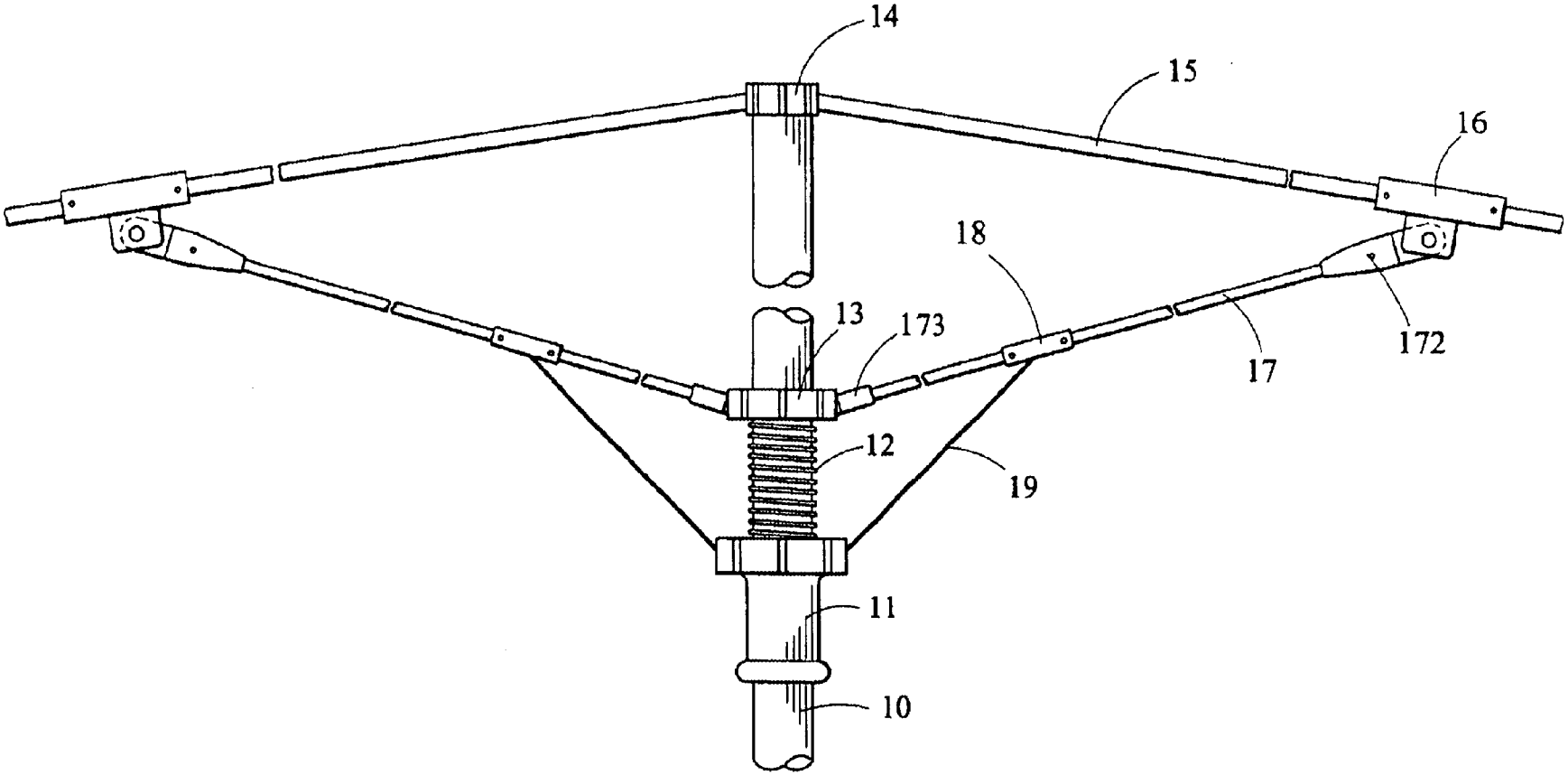
FIG. 4(PRIOR ART)
FIG. 4 is a plane schematic view of the conventional self-opening umbrella.

Referring to FIGS. 1 to 3, the characteristics of the present invention is that the second pivotal-coupling device 18 is capable of being passed through by the two supporting ribs 17 and the second pivotal-coupling device 18 of the supporting rib 17 is integrally formed with a linking member 173 of the supporting rib 17 so as to form a compound pivotal-coupling device (A). Therefore, according to the present invention, by the elasticity of the spiral spring 12, the compound pivotal-coupling device (A) serves to simplify the components of the ribs and thus the yield is increased. Furthermore, the second pivotal-coupling device 18 can be installed at the correct position of the supporting rib 17. Therefore, in producing ribs of different specifications, it is only necessary to update the required specification of compound pivotal-coupling device (A) is enough. Therefore, the yield ratio is improved greatly. The assembly speed can be increased and thus the production cost is reduced.

Referring to FIGS. 2A and 3, another characteristics of the present invention is that the second pivotal-coupling device 18 of the supporting rib 17 is integrally formed with the inner linking member 173 of the supporting rib 17 so as to form a compound pivotal-coupling device (A) which has the inner linking member 173 and one linking member 18 having two tubular members 180—180, a trench 182 between the two tubular members 180—180, a connecting portion 183 in the trench 182, and a plurality of pivotal shaft 186A–186D for pivotally connecting the upper hook 192 of the linkage beam 19. Therefore, two linking members 180—180 are connected integrally. Thereby, ribs of different specification may select different pivotal shaft 186A–186D or update different specification of compound pivotal-coupling device (A) in assembly. In storing the umbrella, the linkage beam 19 can be stored in the trench 182. Therefore, the volume of the frame between the intermediate running hub 13, and bottom running hub 11 (referring to FIG. 3) can be reduced. Therefore, an umbrella with two ribs can be stored in a compact volume.

In summary, since the second pivotal-coupling device for supporting rib is integrally formed with the linking member, the invention is therefore easy in assembly process during manufacturing. Furthermore, the yield ratio will be increased.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A collapsible frame structure for an umbrella with a self-opening mechanism, which comprises:

a main shaft;

a bottom running hub slidably mounted on the main shaft;

an intermediate running hub slidably mounted on the main shaft;

an elastic member mounted on the main shaft between the bottom running hub and the intermediate running hub;

an upper running hub fixedly mounted on a top of the main shaft;

a plurality of main ribs, each being made from enforced FRP and having one end pivotally linked to the upper running hub;

a plurality of supporting ribs having a double-bar beam portion, each being made from enforced FRP and having an outer linking member formed at one end thereof, an inner linking member formed at the other end thereof pivotally linked to the intermediate running hub;

a plurality of linkage beams, each being made from a steel bar formed with a bottom hook connected to the bottom running hub and an upper hook pivotally coupled to one of the supporting ribs;

a plurality of first pivotal-coupling devices, each coupling an outer end of one of the supporting ribs to one of the main ribs, each of the first pivotal-coupling devices including a tubular member to have one of the main ribs pass therethrough and at least one ear formed thereunder with a hole pivotally connected to one of the outer linking members of the supporting rib;

a plurality of second pivotal-coupling devices, each being made through injection molding with nylon plastics, each device including paid inner and said outer linking member and two parallel tubular members, each of said inner and outer linking members being formed with a double-coupling hole for coupling an end of the double-bar beam portion of the supporting ribs to the intermediate running hub and the first pivotal-coupling device said device being formed with a plurality of shafts between said two parallel tubular members so as to enable said shafts to be hooked by the upper hook of a respective linkage beam allowing each of the linkage beams to be pivotally coupled to one of the supporting ribs and the bottom running hub; and an inner end of each tubular member pair being in contact with an outer end of the inner linking member of the support rib.

2. The collapsible frame structure as claimed in claim 1, wherein a trench is formed between the tubular members, and the plurality of shafts are formed within the trench with each of the shafts connecting the two tubular members together.

3. The collapsible frame structure as claimed in claim 2, wherein as the umbrella is folded, each of the linkage beams is stored in the trench of the associated second pivotal-coupling device.

* * * * *